United States Patent [19]

Chang

[11] Patent Number: 4,970,811

[45] Date of Patent: Nov. 20, 1990

[54] ADVERTISING DEVICE FOR A VENDING MACHINE

[75] Inventor: Bo H. Chang, Suwon, Rep. of Korea

[73] Assignee: Samsung Electronics Co., Ltd., Rep. of Korea

[21] Appl. No.: 370,868

[22] Filed: Jun. 23, 1989

[30] Foreign Application Priority Data

Jun. 25, 1988 [KR] Rep. of Korea ..... 1988-9884

[51] Int. Cl.[5] ..... G09F 19/02

[52] U.S. Cl. ..... 40/431; 40/538

[58] Field of Search ..... 40/430, 431, 427, 538, 40/409

[56] References Cited

U.S. PATENT DOCUMENTS

| | | | |
|---|---|---|---|
| 462,510 | 11/1891 | Roemer et al. | 40/431 |
| 1,715,129 | 5/1929 | Gritt | 40/431 |
| 1,804,595 | 5/1931 | Curtiss | 40/427 |
| 2,020,603 | 11/1935 | Gearhart | 40/431 |
| 2,214,410 | 9/1940 | Evans | 40/431 |
| 3,905,140 | 9/1975 | Damiano | 40/409 |

FOREIGN PATENT DOCUMENTS

| | | | |
|---|---|---|---|
| 830387 | 3/1960 | United Kingdom | 40/427 |

*Primary Examiner*—James R. Brittain

*Attorney, Agent, or Firm*—Saidman, Sterne, Kessler & Goldstein

[57] ABSTRACT

An advertising device for a vending machine which can display the image of serving drinks out of a tea-kettle into a cup or the like. The device includes first and second displays installed inside of a transparent or semi-transparent billboard in front of the machine. The first and second displays are controlled to operate in relation to the operation of the machine and display the images of serving drinks out of the tea-kettle and the steaming from the cup respectively.

3 Claims, 2 Drawing Sheets

ADVERTISING DEVICE FOR A VENDING MACHINE

BACKGROUND OF THE INVENTION

1. Field of the Invention

The present invention relates to an advertising device for a vending machine and more particularly, to an advertising device for a vending machine for the sale of drink such as tea, coffee, etc., which can display the image of serving the drinks out of a tea-kettle into a cup or the like when the machine is operated.

2. Description of the Prior Arts

In the conventional vending machines, merely a printed picture or a photograph is installed on a billboard in front of the machine for advertisement.

On the other hand, Japanese Patent Laid-Open No. 51-124498 (laid-open on Oct. 29, 1976) discloses a vending machine having a display device which is operated in relation to the heating operation for foods. This display device comprises a light source and an endless film for advertisement which are installed in a transparent advertising billboard. According to this device, the endless film is operated for movement while the food is heated.

However, since such advertising devices merely display advertising pictures or photographs, they can not have the users amused for being served by the machine.

SUMMARY OF THE INVENTION

It is an object of the present invention to provide an advertising device for a vending machine which can improve the effectiveness of advertisement by displaying and giving the image of serving drinks out of a tea-kettle into a cup when the machine is operated for sale.

It is another object of the present invention to provide an advertising device which can especially be adapted to a vending machine for amusing the users who are served by the machine.

In accordance with the present invention, there is provided an advertising device for a vending machine comprising: a transparent or semitransparent advertising billboard mounted in front of the machine, said billboard having prints or models of a tea-kettle and a cup or the like which are attached thereto; a light source installed inside of said billboard for illuminating said billboard; first means for displaying the image of drinks being poured out of said tea-kettle into said cup; and second means for displaying the image of steaming in said cup; wherein said driving of said first and second display means are controlled to operate in relation to the operation of said vending machine.

BRIEF DESCRIPTION OF THE DRAWINGS

The present invention will now be described by way of illustrative examples with reference to the accompanying drawings, in which.

DETAILED DESCRIPTION OF THE PREFERRED EMBODIMENTS

Figure 1:
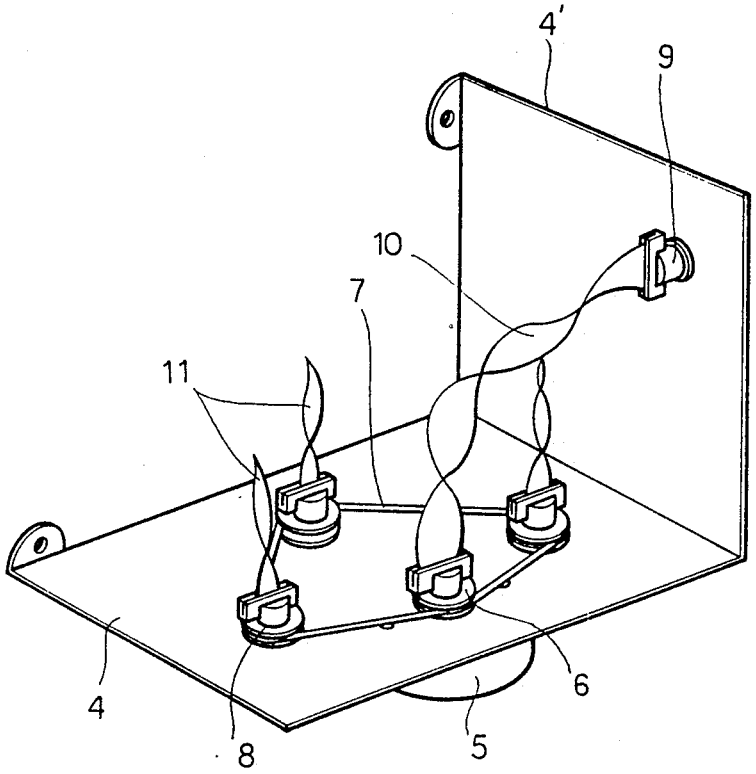
FIG. 1 is a perspective view of an advertising device in accordance with an embodiment of the present invention.
Figure 2:
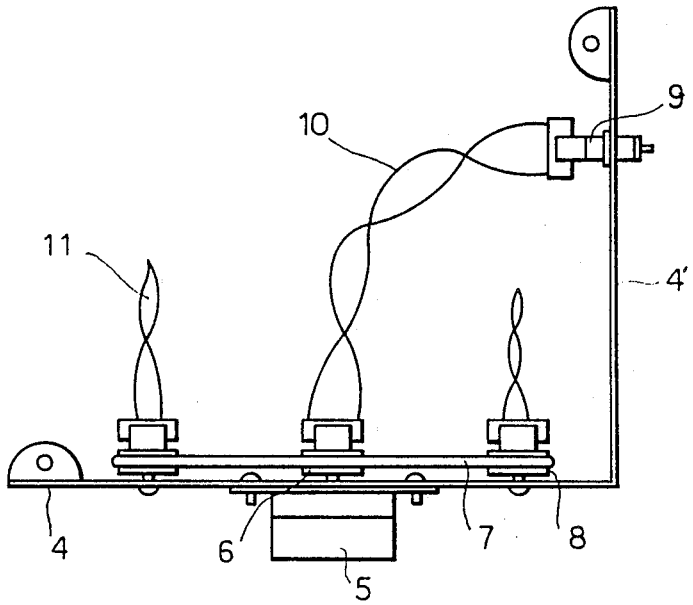
FIG. 2 is a front elevation of the device of FIG. 1.
Figure 3:
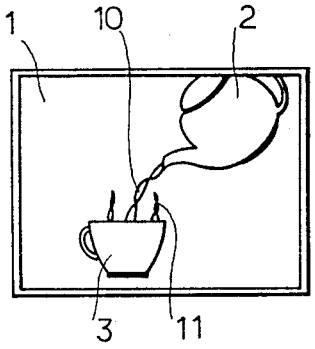
FIG. 3 is a front elevation showing the device of FIG. 1 in operation.

Referring to FIG. 3, a picture or a photograph of a tea-kettle 2 and a cup 3 is printed on a transparent or semitransparent billboard 1 which is mounted in front of the machine.

Figure 4:
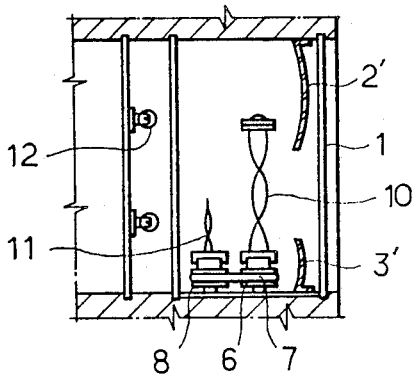
FIG. 4 is a partially cutaway side elevation of an advertising device illustrating a further embodiment of the present invention.

Referring to FIG. 4 showing a further embodiment of the invention, models 2' and 3' of the tea-kettle and cup are fixed just behind the billboard 1. Between the billboard 1 and each lamp 12, first and second display means are provided.

In the embodiments of the invention, the first display means comprises a fixing panel 4 horizontally installed inside of the board 1, a geared motor 5 fixed on the fixing panel 4, a driving pulley 6 installed on the fixing panel 4 and rotated by the geared motor 5, a side panel 4' installed in a parallel direction with the side of the machine, a rotary member 9 mounted on the side panel to rotate itself, and first display member, both ends of which are connected to the driving pulley 6 and the rotary member 9 respectively and which remains twisted several times to display the image of the drink being poured from the kettle 2 into the cup 3. In the embodiments, the first display member is a vinyl sheet 10 which is made of glossy celluloid.

As can be seen in FIG. 3, both end portions of the vinyl sheet 10 are connected between the driving pulley 6 and the rotary member 9 are respectively placed to meet the outlet of the kettle 2 and the middle of the cup 3 on the billboard 1.

On the other hand, the second display means comprises a plurality of driven pulleys 8, a driving belt 7 carrying motion from the driving pulley 6 to the driven pulleys 8, and second display member having a plurality of vinyl sheets 11 which are fixed to said driven pulleys 8 respectively and which remain twisted to display the image of the steaming in the cup 3. The vinyl sheet 10 is twisted in such a direction that the drink is shown to be poured out of the kettle 2 into the cup 3 when the motor 5 rotates in a normal direction. The vinyl sheets 11 are twisted in the reverse direction to that of the vinyl sheet 10 so as to display the image of the steaming in the cup 3 when the motor 5 rotates in a normal direction.

While the "ON SALE" indication lamp is turned on, the motor 5 is operated to rotate the driving pulley 6 and the driven pulleys 8 via the belt 7, causing the vinyl sheets 10 and 11 to rotate. In this moment, the vinyl sheet 10 displays the image of the drink being poured from the kettle 2 to the cup 3 and the vinyl sheets 11 displays the image of the steaming within the cup 3 as shown in FIG. 3, resulting in that the user has a feeling that the drink is actually poured out of the kettle.

From the foregoing, it will be apparent that the present invention provides a novel advertising device specially designed and constructed to induce the customer's interest and to improve the effectiveness of the advertisement by displaying the images that drinks are poured out of a tea-kettle and hot drinks steam up within a cup.

While the present invention has been described and illustrated herein with reference to the preferred embodiments thereof, it will be understood by those skilled in the art that various changes in form and details may be made therein without departing from the spirit and scope of the invention.

What is claimed is:

1. An advertising device for a vending machine having a transparent or semitransparent advertising billboard mounted in front of the machine and having prints of a tea-kettle and a cup attached to the transparent or semitransparent advertising billboard, and a light source installed inside of the billboard, the device comprising;

first means for displaying the image of a hot drink being poured out of said tea-kettle into said cup, said first means comprising a first panel member horizontally installed inside of said billboard, a geared motor fixed on said first panel member, a driving pulley fixed on said panel member parallel to a side of said machine, a second panel member connected to said first panel member, a rotary member mounted on said second panel member, and a first display member having a first end and a second end, said first end being connected to said driving pulley and said second end being connected to said rotary member, wherein rotation of said driving pulley causes said first display member to rotate;

second means for displaying the image of said hot drink steaming within said cup; and wherein said first and second display means are controlled to operate in relation to the selling operation of the machine.

2. The device of claim 1, wherein said second means comprise a plurality of pulleys driven by said driving pulley and a plurality of second display members, said second display members having a first and second end, wherein said first end of each of said second display members is fixed to one of said plurality of driven pulleys and said second end of each of said display members is free.

3. The device of claim 2, wherein said first display means are elastic and twisted in opposite directions.

* * * * *